US012781985B2

(12) United States Patent
Cheong et al.

(10) Patent No.: US 12,781,985 B2
(45) Date of Patent: Nov. 3, 2026

(54) SINGLE ZONE HVAC PREDICTION SYSTEM AND METHOD FOR OPEN PLAN LARGE-SCALE BUILDING

(71) Applicant: KOREA UNIVERSITY RESEARCH AND BUSINESS FOUNDATION, Seoul (KR)

(72) Inventors: Tae Su Cheong, Seoul (KR); Han Seok Seo, Incheon (KR); Dong Hwan Shin, Seoul (KR); Min Jei Park, Busan (KR)

(73) Assignee: KOREA UNIVERSITY RESEARCH AND BUSINESS FOUNDATION, Seoul (KR)

( * ) Notice: Subject to any disclaimer, the term of this patent is extended or adjusted under 35 U.S.C. 154(b) by 266 days.

(21) Appl. No.: 18/783,992

(22) Filed: Jul. 25, 2024

(65) Prior Publication Data

US 2025/0172309 A1 May 29, 2025

(30) Foreign Application Priority Data

Nov. 24, 2023 (KR) ..... 10-2023-0165309

(51) Int. Cl.
*F24F 11/63* (2018.01)
*F24F 11/54* (2018.01)
*F24F 11/58* (2018.01)

(52) U.S. Cl.
CPC ..... *F24F 11/63* (2018.01); *F24F 11/54* (2018.01); *F24F 11/58* (2018.01)

(58) Field of Classification Search
CPC ..... F24F 11/54; F24F 11/58; F24F 11/63
See application file for complete search history.

(56) References Cited

U.S. PATENT DOCUMENTS

| | | | | |
|---|---|---|---|---|
| 11,921,824 | B1 * | 3/2024 | Hester | G06N 3/045 |
| 2016/0327295 | A1 * | 11/2016 | Ward | G05B 15/02 |
| 2021/0003308 | A1 * | 1/2021 | Venne | F24F 11/58 |
| 2021/0191342 | A1 * | 6/2021 | Lee | F24F 11/62 |
| 2022/0260272 | A1 * | 8/2022 | Kim | G06N 3/08 |

FOREIGN PATENT DOCUMENTS

KR 10-2022-0025511 A 3/2022

OTHER PUBLICATIONS

Korean Office Action issued on Oct. 4, 2024, in connection with the Korean Patent Application No. 10-2023-0165309, with its English translation, 11 pages.

* cited by examiner

*Primary Examiner* — Omer S Khan
(74) *Attorney, Agent, or Firm* — Hauptman Ham, LLP

(57) ABSTRACT

Disclosed are a single zone HVAC prediction system and method for an open plan large-scale building. The single zone HVAC prediction system for an open plan large-scale building includes: a plurality of IoT terminals each installed inside and outside the building to acquire at least one of HVAC information, control information, facility-related information, and environmental information; and a server collecting the HVAC information, the control information, the facility-related information, and the environmental information from the plurality of IoT terminals, preprocessing the collected information to form a data set, applying the data set to a trained deep learning-based prediction model, and reflecting a correlation between the HVAC information and the control information and a daily pattern of the environmental information through the time embedding to output an HVAC prediction value.

5 Claims, 6 Drawing Sheets

SINGLE ZONE HVAC PREDICTION SYSTEM AND METHOD FOR OPEN PLAN LARGE-SCALE BUILDING

CROSS-REFERENCE TO RELATED APPLICATION

This application claims under 35 U.S.C. § 119 (a) the benefit of Korean Patent Application No. 10-2023-0165309 filed on Nov. 24, 2023, the entire contents of which are incorporated herein by reference.

BACKGROUND

(a) Technical Field

The present invention relates to a single zone HVAC prediction system and method for an open plan large-scale building.

(b) Background Art

A building energy management system (hereinafter referred to as BEMS) is a control, management, and business system that uses computers to help building managers maintain and conserve a safe, hygienic, and comfortable living environment and functional work environment for residents based on reasonable energy use.

By using the BEMS, it is possible to check and manage energy usage, indoor environment, and building carbon emissions, and it is possible to not only save about 10% to 30% of energy on average, but also create a comfortable environment in a building, extend the life of the building, etc.

The conventional BEMS technologies have difficulty in communicating between sensors installed in distant locations and distribution boards installed inside concrete walls, and are a technology that physically analyzes the flow of air inside a building like computational fluid dynamics (CFD) and is capable of simulating HVAC environment, but has the problem in that in open plan large-scale buildings, the costs of computing resources required for analysis are high, and the calculation time increases exponentially, resulting in poor real-time performance.

SUMMARY OF THE DISCLOSURE

The present invention relates to a single zone HVAC prediction system and method for an open plan large-scale building.

In addition, the present invention provides a single zone HVAC prediction system and device for an open plan large-scale building that can be effectively applied to the open plan large-scale building by providing accurate HVAC prediction information reflecting spatio-temporal characteristics using advantages of wireless communication.

In addition, the present invention provides a single zone HVAC prediction system and device for an open plan large-scale building capable of simulating a large-scale and complex HVAC environment through data-based learning without a hydrodynamic calculation, and being quickly adapted to a change (expansion, etc.) in the environment.

In addition, the present invention provides a single zone HVAC prediction system and device for an open plan large-scale building capable of implementing high consistent predictions by allowing a model to train time zones that provide useful information and time zones that do not provide useful information through time embedding, and constructing an automated HVAC prediction system based on the prediction.

According to an aspect of the present invention, there is provided a single zone HVAC prediction system for an open plan large-scale building.

According to an embodiment of the present invention, a single zone HVAC prediction system for an open plan large-scale building includes: a plurality of IoT terminals each installed inside and outside the building to acquire at least one of HVAC information, control information, facility-related information, and environmental information; and a server collecting the HVAC information, the control information, the facility-related information, and the environmental information from the plurality of IoT terminals, preprocessing the collected information to form a data set, applying the data set to a trained deep learning-based prediction model, and reflecting a correlation between the HVAC information and the control information and a daily pattern of the environmental information through the time embedding to output an HVAC prediction value.

The deep learning-based prediction model may additionally input a result of performing self-attention on the HVAC information and at least one of the control information and environmental information to first latent array to perform a first cross-attention, additionally input the daily pattern of the environmental information through the time embedding to a second latent array to perform a second cross-attention on a result of performing the first cross-attention, and then refine a latent expression through a transformer to output an HVAC prediction value.

The server may receive daily time data expressed in predetermined time units, and then sequentially vary a masking range in consideration of a time change for prediction for each hour to apply the time embedding.

The single zone HVAC prediction system may further include a monitoring device outputting visual information for monitoring based on the HVAC prediction value and a current HVAC value.

The environmental information may include indoor environmental information and weather environmental information, and the indoor environmental information may be at least one of indoor humidity, fine dust, carbon monoxide, and carbon dioxide.

According to another aspect of the present invention, there is provided a single zone HVAC prediction method of an open plan large-scale building.

According to an embodiment of the present invention, a single zone HVAC prediction method of an open plan large-scale building includes: (a) collecting at least one of HVAC information, control information, facility-related information, and environmental information, respectively, through IoT terminals each installed inside and outside the building; (b) collecting the HVAC information, the control information, the facility-related information, and the environmental information from the plurality of IoT terminals and then preprocessing the collected information to form a data set; and (c) applying the data set to a trained deep learning-based prediction model to reflect a correlation between the HVAC information and the control information and a daily pattern of the environmental information through time embedding to output an HVAC prediction value.

The single zone HVAC prediction method may further include: training the deep learning-based prediction model before step (c), in which, in the training of the deep learning-based prediction model, a result of performing self-attention on the HVAC information and at least one of the control information and environmental information may be additionally input to a first latent array to perform a first cross-attention, and the daily pattern of the environmental information through the time embedding may be additionally input to a second latent array to perform a second cross-attention on a result of performing the first cross-attention, and then a latent expression may be refined through a transformer and trained to output an HVAC prediction value.

A single zone HVAC prediction system and device for an open plan large-scale building device according to an embodiment of the present invention can be effectively applied to the open plan large-scale buildings by utilizing the advantages of wireless communication to provide accurate HVAC prediction information reflecting the spatio-temporal characteristics.

In addition, according to the present invention, it is possible to simulate the large-scale and complex HVAC environment through the data-based learning without the hydrodynamic calculation, and be quickly adapted to change (expansion, etc.) in the environment.

In addition, according to the present invention, it is possible to implement high consistent predictions by allowing the model to train the time zones that provide the useful information and the time zones that do not provide the useful information through the time embedding, and constructing the automated HVAC prediction system based on the prediction.

DETAILED DESCRIPTION

Singular forms as used herein include plural forms unless the context clearly indicates otherwise. The term "including", "include', or the like, as used herein is not to be construed as necessarily including all of several components or several steps described herein, and it is to be construed that some of these components or steps may not be included or additional components or steps may be further included. In addition, the terms "unit", "module", and the like, as used herein refer to a processing unit of at least one function or operation and may be implemented as hardware or software or a combination of hardware and software.

Hereinafter, embodiments of the present disclosure will be described in detail with reference to the accompanying drawings.

Figure 1:
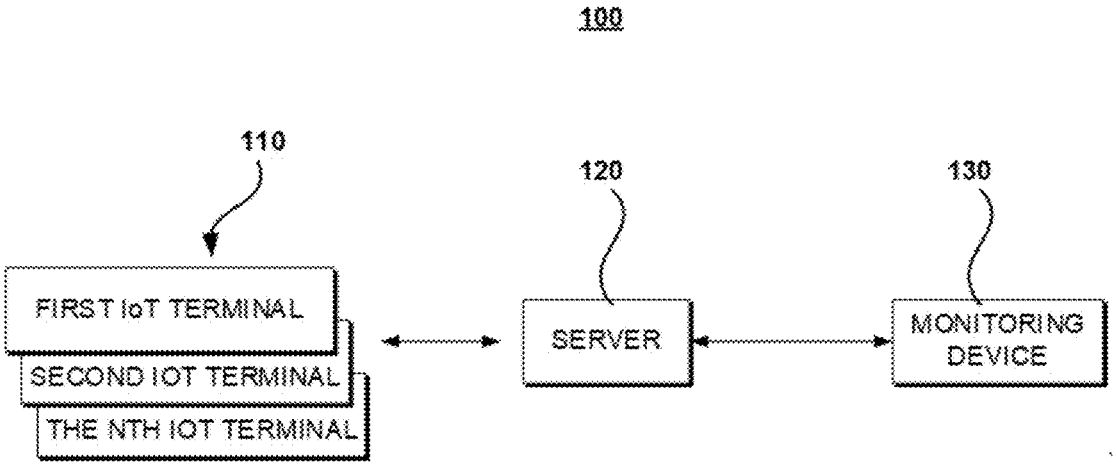
FIG. 1 is a diagram schematically illustrating a configuration of a single zone HVAC prediction system for an open plan large-scale building according to an embodiment of the present invention.

FIG. 1 is a diagram schematically illustrating a configuration of a single zone HVAC prediction system for an open plan large-scale building according to an embodiment of the present invention.

Referring to FIG. 1, a single zone HVAC prediction system 100 for an open plan large-scale building according to an embodiment of the present invention is configured to include a plurality of IoT terminals 110, a server 120, and a monitoring device 130.

The plurality of IoT terminals 110 may each be installed at specific locations in a single space within an open plan large-scale building, or may be devices that are linked to an HVAC system or a facility system.

For example, the plurality of IoT terminals 110 may detect indoor environmental information such as humidity, (ultra) fine dust, carbon monoxide, and carbon dioxide or may be linked to the HVAC system, acquire HVAC information of a current system related to ventilation or/and cooling and heating within the HVAC system, acquire HVAC control information such as setting values, control signals, and maximum demand power of each HVAC system, measure resource usage (i.e., current values for each phase inside the system) inside the building to operate the HVAC system, or acquire indoor facility-related information, such as temperature of a showcase and the number of times of opening/closing of an automatic door, in order to distinguish factors that affect the indoor HVAC environment.

The server 120 collects the indoor environmental information, HVAC-related information, resource use-related information, facility-related information, and weather information from the plurality of IoT terminals 110, and applies the collected information to the trained deep learning-based prediction model to output an HVAC prediction value. This will be described in more detail below with reference to FIG. 2.

The monitoring device 130 is linked to the server 120 and outputs visual information for monitoring using the HVAC prediction value and the current HVAC value provided by the server 120. Here, the monitoring device 130 may provide information helpful in operating and managing the HVAC system based on the HVAC prediction value and current HVAC value by expressing the information in a real time dashboard.

In an embodiment of the present invention, the description is focused on the assumption that the server 120 and the monitoring device 130 are separate components. However, depending on the implementation method, the server 120 and the monitoring device 130 may be one device.

The plurality of IoT terminals 110, the server 120, and the monitoring device 130 may transmit and receive data through low-power long-distance communication. Here, the low-power long-distance communication may be, for example, LoraWAN. The LoraWAN enables long-distance communication even with low power through an adaptative data rate (ADR) characteristic that adjusts a data rate (DR) according to a spreading factor (SF) of each device, and may secure communication stability by minimizing data interference.

Figure 2:
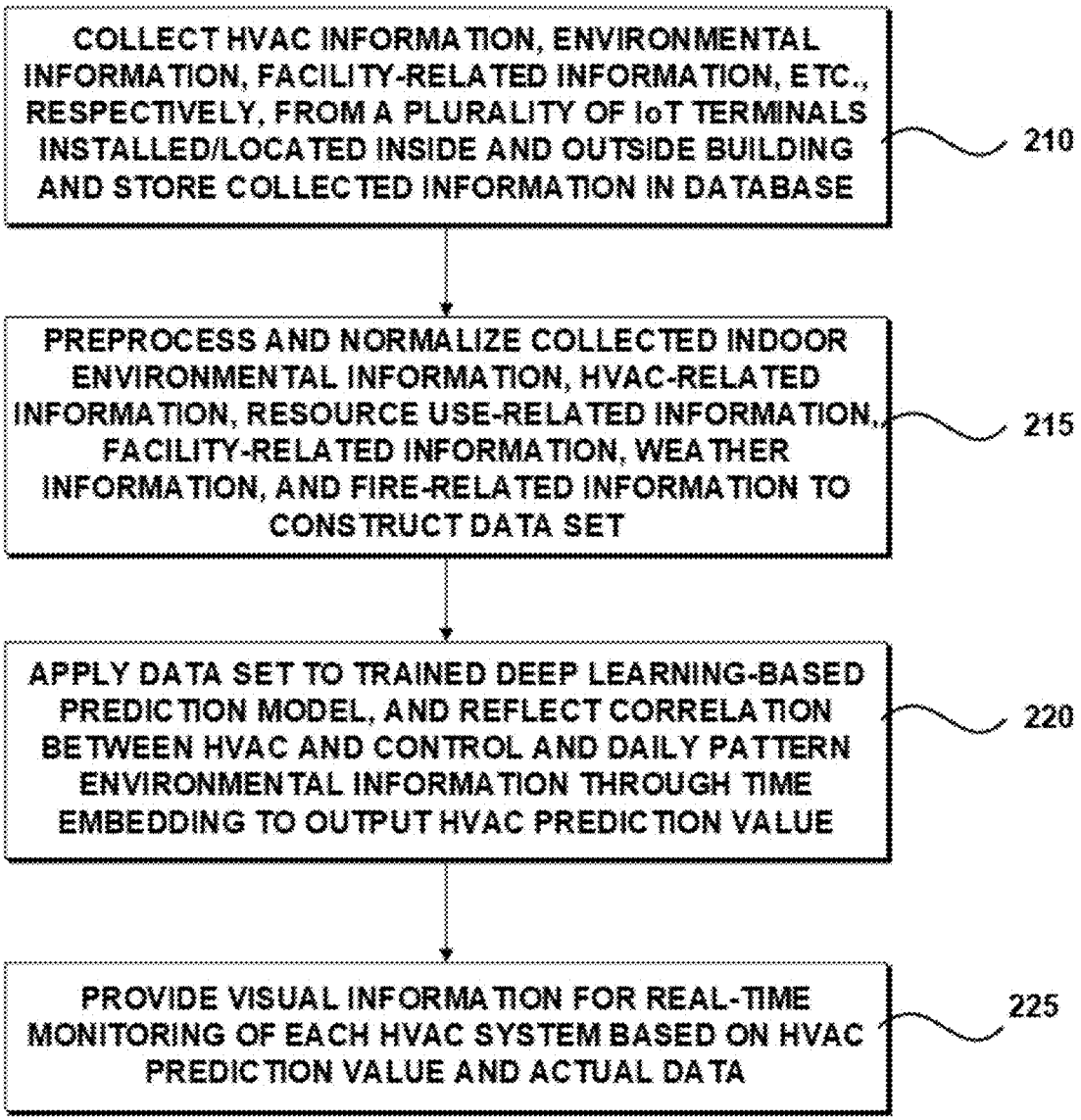
FIG. 2 is a flowchart illustrating a single zone HVAC prediction method of an open plan large-scale building according to an embodiment of the present invention.
Figure 3:
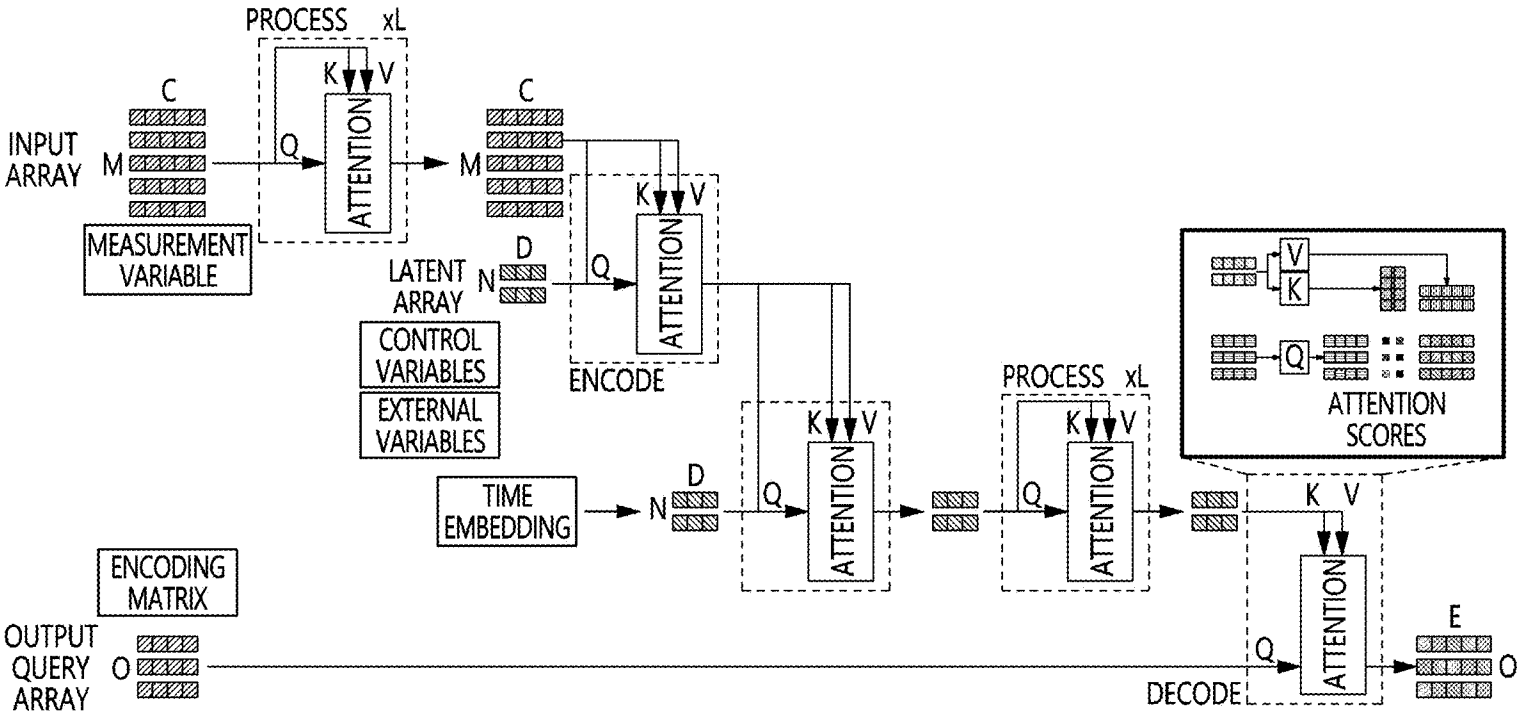
FIG. 3 is a diagram illustrating the overall structure of a deep learning-based prediction model according to an embodiment of the present invention.
Figure 4:
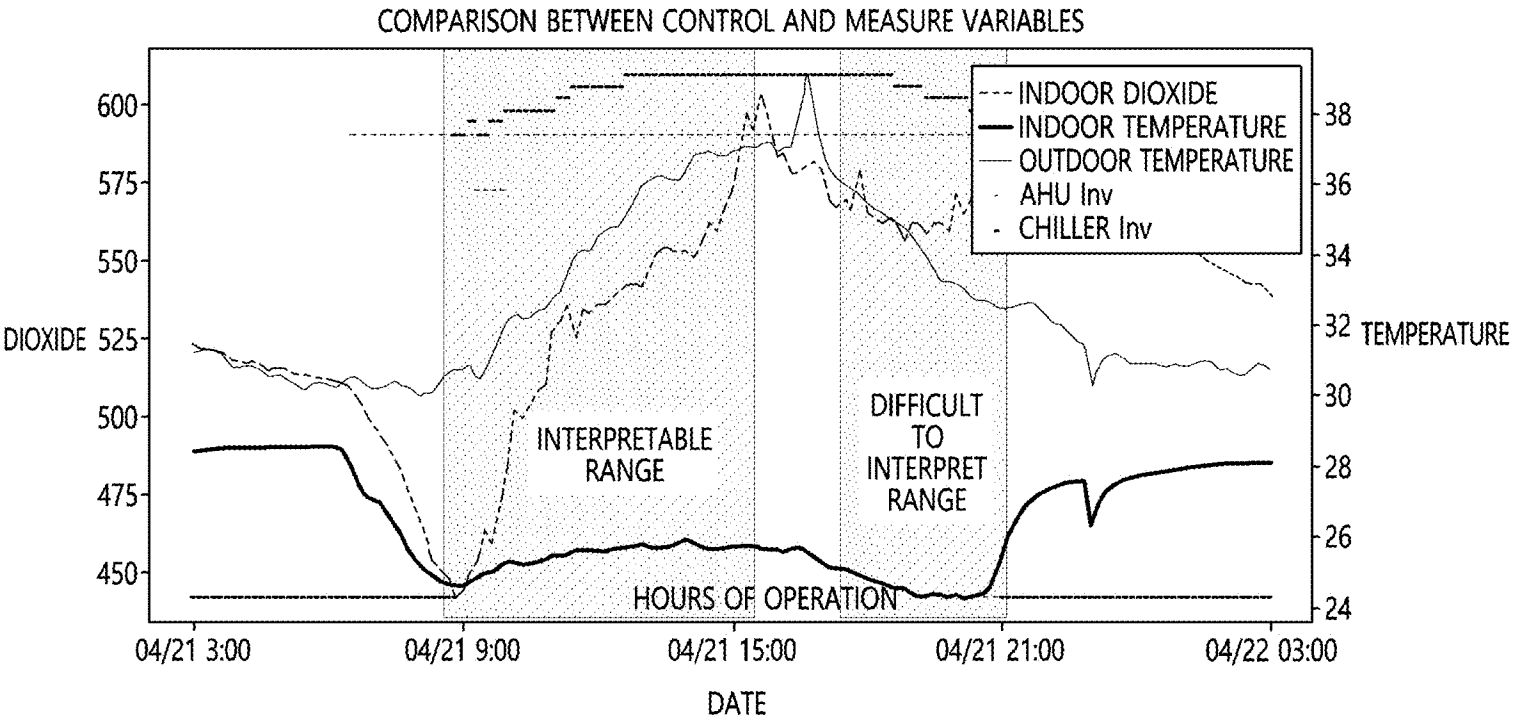
FIG. 4 is a diagram illustrating a pattern of environmental information over time according to an embodiment of the present invention.
Figure 5:
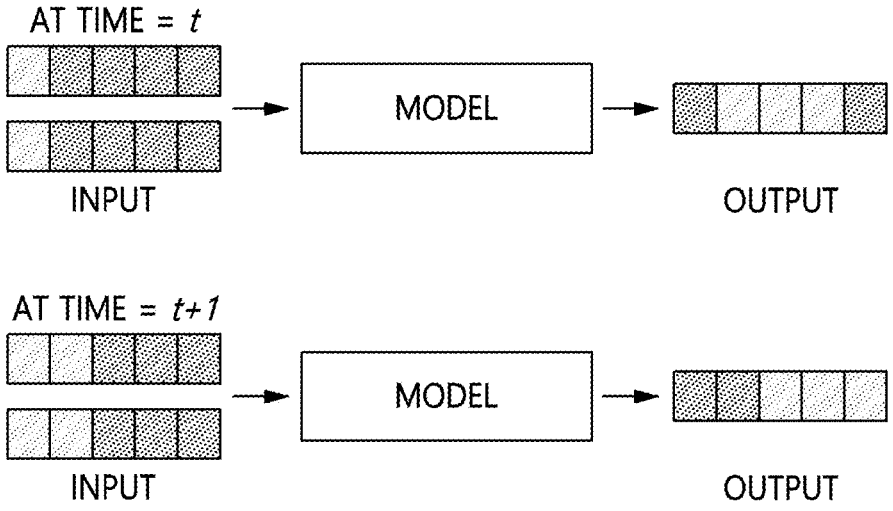
FIG. 5 is a diagram illustrating time embedding according to an embodiment of the present invention.

FIG. 2 is a flowchart illustrating a single zone HVAC prediction method of an open plan large-scale building according to an embodiment of the present invention, FIG. 3 is a diagram illustrating the overall structure of a deep learning-based prediction model according to an embodiment of the present invention, FIG. 4 is a diagram illustrating a pattern of environmental information over time according to an embodiment of the present invention, and FIG. 5 is a diagram illustrating time embedding according to an embodiment of the present invention.

In step 210, the server 120 collects HVAC-related information, environmental information, facility-related information, etc., from the plurality of IoT terminals 110 installed/located inside and outside the building, respectively, and stores the collected information in a database.

Here, the HVAC-related information may include the HVAC information and the HVAC control information. The HVAC information is HVAC information of the current system related to ventilation, cooling, and heating within the HVAC system, and HVAC control information may include the setting values, control information, and maximum demand power of the HVAC system.

In addition, the environmental information includes the indoor environmental information and external environmental information, and the indoor environmental information may include humidity, (ultra) fine dust, carbon monoxide, carbon dioxide, etc., for a single space within the open plan large-scale building. In addition, the external environmental information may be the weather environmental information.

In addition, the facility-related information may include the temperature of the showcase, the number of times of opening/closing of the automatic door lock, etc. to distinguish factors that affect the indoor HVAC environment.

In addition, fire-related information may be collected additionally. Here, the fire-related information may be the electric heat pump (EPH) set temperature. This EHP set temperature may be used to identify load situations and fire situations.

In step 215, the server 120 preprocesses and normalizes the collected indoor environmental information, HVAC-related information, resource use-related information, facility-related information, weather information, and fire-related information, and then constructs a data set.

In this way, each piece of information collected through different IoT terminals may have different scales and distributions.

Accordingly, the server 120 may preprocess each piece of information (e.g., HVAC-related information, environmental information, facility-related information) collected through different IoT terminals and normalize and standardize the data to construct the data set.

In addition, when constructing the data set, the data set may be constructed after extracting information corresponding to the reflection time from the database and verifying integrity and the presence of outliers.

In step 220, the server 120 applies the data set to the trained deep learning-based prediction model and outputs an HVAC prediction value by reflecting the correlation between HVAC and control and the daily pattern of the environmental information through the time embedding.

To facilitate understanding and description, the process of training the deep learning-based prediction model will be described in more detail.

The detailed structure of the deep learning-based prediction model is illustrated in FIG. 3. As illustrated in FIG. 3, the deep learning-based prediction model is a transformer-based spatio-temporal attention model.

According to an embodiment of the present invention, the spatial influence and the flow of air over time between each IoT terminal and the HVAC device may be simulated through the deep learning-based prediction model which is a transformer-based spatio-temporal attention model as illustrated in FIG. 3. For example, it is assumed that the current temperature is predicted. The current temperature is affected by two types of features such as past temperature and past control.

Accordingly, the server 120 uses the deep learning-based prediction model to perform the self-attention in order to know how much past HVAC information (e.g., temperature) is affected by the current state (temperature) in order to predict the HVAC information at the current time based on the data set. As illustrated in FIG. 3, after inputting the HVAC information to the input array, the self-attention with an input data set with the same query, key, and value may be performed based on a transformer structure. Since the self-attention operation itself is self-evident to those skilled in the art, detailed description thereof will be omitted.

Unlike the cross-attention of a typical transformer, the control information that affects the current temperature constructs a data set of different dimensions with different queries, keys, and values.

Therefore, after additionally inputting the control information to a latent array, the server 120 may train the correlation between the HVAC information and the control information in the deep learning-based prediction model through the cross-attention.

Like the control information, after additionally inputting the environmental information to the latent array, the server 120 may perform the cross-attention to train the correlation between HVAC information and environmental information in the deep learning-based prediction model.

The data that affects the indoor temperature in the data set is the control information and environmental information, and among these, a level of occupancy, which has a significant impact on the indoor temperature, may be determined using carbon dioxide.

To facilitate understanding and description, the description will be made with reference to FIG. 4.

As illustrated in FIG. 4, a carbon dioxide concentration in a specific indoor space is helpful in determining the level of occupancy from am to 3 pm, but after that, the carbon dioxide concentration accumulates due to lack of ventilation, so the carbon dioxide concentration alone indicates a high occupancy rate.

Therefore, the deep learning-based prediction model should be trained to distinguish between helpful and unhelpful time zones in determining the occupancy rate in a specific indoor space based on the carbon dioxide concentration.

Therefore, in an embodiment of the present invention, trainable parameters may be additionally input to the latent array through the time embedding so that the deep learning-based prediction model may be trained by distinguishing necessary information from unnecessary information through daily patterns.

To understand the daily patterns, the time embedding may configure 24 hours in units of 10 minutes and then may be configured as the latent array from 0:00 to 24:00.

In the case of a general time series model, a window slicing method is a method of constructing a certain time unit as a window, and then pushing the window in step units to construct data.

However, in an embodiment of the present invention, a method of identifying daily patterns by inputting daily time data at predetermined time intervals and then sequentially varying a masking range in consideration of time changes for prediction for each hour is applied.

The description will be made with reference to FIG. 5.

As illustrated in FIG. 5, the masking ranges applied to each time point (e.g., the first time and the second time) for the daily time data are different. At the first time, the mask may be applied to the remaining time area except for the first time and applied to the deep learning-based prediction model, and at the second time, the mask may be applied to the remaining time area except for the first time and the second time and applied to the deep learning-based prediction model. In this way, the time data with the masking ranges sequentially varied may be applied to the deep learning-based prediction model to recognize the time change (i.e., daily pattern).

Referring back to FIG. 3, the server 120 may perform training to re-perform the cross-attention on the results of performing the cross-attention on the HVAC information and the control information and the time data additionally input to the latent array through the time embedding, and then refine the latent expression through the transformer to output the current HVAC prediction value.

In this way, the server 120 applies the current data set to the trained deep learning-based prediction model and then output the HVAC prediction value by considering the correlation between the HVAC information and the control information and the environmental information according to the time-embedded daily pattern.

In step 225, the server 120 provides visual information for real-time monitoring of each HVAC system based on the HVAC prediction value and the actual data.

The visual information provided in this way may be used to assist HVAC system control decision-making, such as air quality status, status of power measurement sensors, pattern analysis for each sensor, comparison of usage for each load, etc.

Figure 6:
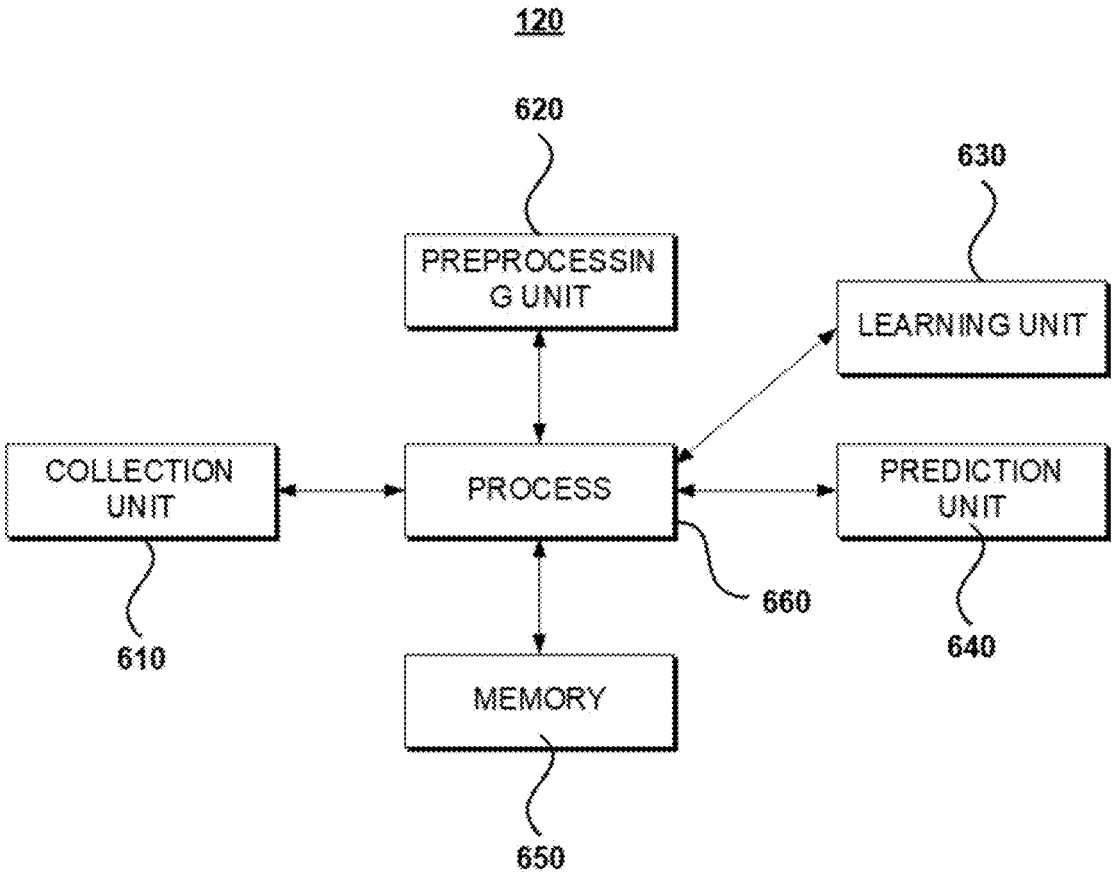
FIG. 6 is a block diagram schematically illustrating an internal configuration of a server according to an embodiment of the present invention.

FIG. 6 is a block diagram schematically illustrating an internal configuration of a server according to an embodiment of the present invention.

Referring to FIG. 6, the server 120 according to an embodiment of the present invention is configured to include a collection unit 610, a preprocessing unit 620, a learning unit 630, a prediction unit 640, a memory 650, and a processor 660.

The collection unit 610 collects at least one of the HVAC information, the control information, the facility-related information, and the environmental information, respectively, through the IoT terminals each installed inside and outside the building, and stores the collected information in the database.

The preprocessing unit 620 preprocesses, normalizes, and then standardizes the collected data to form the data set.

The learning unit 630 is a means for training the deep learning-based prediction model using the data set. For example, the learning unit 630 may train how past HVAC information affects the current HVAC information through the self-attention to the HVAC information based on the data set. In addition, the learning unit 630 may train the correlation between the HVAC information and the control information in the deep learning-based prediction model. To this end, the result of performing the self-attention on the HVAC information and the control information are additionally input to the first latent array to perform the cross-attention, so the correlation between the HVAC information and the control information may be trained in the deep learning-based prediction model. In addition, the daily patterns of the environmental information may be trained in the deep learning-based prediction model through the time embedding. In other words, after re-performing the cross-attention on the results of performing the cross-attention on the HVAC information and the control information by additionally inputting the daily pattern of the environmental information to the second latent array through the time embedding, the latent expression may be refined through the transformer and trained to derive the HVAC prediction value.

The prediction unit 640 applies the data set to the trained deep learning-based prediction model, and outputs the HVAC prediction value by considering the correlation between the HVAC information and the control information and the daily pattern of the environmental information through the time embedding.

The memory 650 stores program code for performing a single zone HVAC control method of an open plan large-scale building according to an embodiment of the present invention.

The processor 660 is a means for controlling the internal components (e.g., collection unit 610, preprocessing unit 620, learning unit 630, prediction unit 640, memory 650, etc.) of the server 120 according to an embodiment of the present invention.

When the server 120 performs the function of the monitoring device 130, the processor 660 may provide the visual information for real-time monitoring of the HVAC system based on the HVAC prediction values and the actual data.

The apparatus and the method according to an embodiment of the present disclosure may be implemented in the form of program commands that may be executed through various computer units and be recorded in a computer-readable recording medium. The computer-readable recording medium may include program commands, data files, data structures, or the like, alone or in combination. The program commands recorded in the computer-readable recording medium may be specially designed and constituted for the present disclosure or be known to and usable by those skilled in a computer software field. Examples of the computer-readable recording medium may include magnetic media such as hard disks, floppy disks, and magnetic tapes; optical media such as compact disk read only memories (CD-ROMs) and digital versatile disks (DVDs); magneto-optical media such as floptical disks; and hardware devices specially configured to store and execute program commands, such as ROMs, random access memories (RAMs), and flash memories. Examples of the program commands include high-level language codes capable of being executed by a computer using an interpreter, or the like, as well as machine language codes made by a compiler.

The above-described hardware devices may be constituted to be operated as one or more software modules in order to perform operations of the present disclosure, and vice versa.

Embodiments of the present disclosure have been mainly described hereinabove. It will be understood by those skilled in the art to which the present disclosure pertains that the present disclosure may be implemented in a modified form without departing from essential characteristics of the present disclosure. Therefore, embodiments disclosed herein should be considered in an illustrative aspect rather than a restrictive aspect. The scope of the present disclosure should be defined by the claims rather than the above description, and equivalents to the claims should be interpreted to fall within the present disclosure.

What is claimed is:

1. A single zone HVAC prediction system for an open plan large-scale building, comprising:

a plurality of IoT terminals each installed inside and outside a building to acquire at least one of HVAC information, control information, facility-related information, and environmental information; and a server collecting the HVAC information, the control information, the facility-related information, and the environmental information from the plurality of IoT terminals, preprocessing the collected information to form a data set, applying the data set to a trained deep learning-based prediction model, and reflecting a correlation between the HVAC information and the control information and a daily pattern of the environmental information through the time embedding to output an HVAC prediction value;

wherein the deep learning-based prediction model additionally inputs a result of performing self-attention on the HVAC information and at least one of the control information and environmental information to a first latent array to perform a first cross-attention, and additionally inputs the daily pattern of the environmental information through the time embedding to a second latent array, performs a second cross-attention on a result of performing the first cross-attention, and then refines a latent expression through a transformer to output an HVAC prediction value;

wherein the HVAC prediction value is used to assist control of the single zone HVAC system.

2. The single zone HVAC prediction system of claim 1, wherein the server receives daily time data expressed in predetermined time units, and then sequentially varies a masking range in consideration of a time change for prediction for each hour to apply the time embedding.

3. The single zone HVAC prediction system of claim 1, further comprising:

a monitoring device outputting visual information for monitoring based on the HVAC prediction value and a current HVAC value.

4. The single zone HVAC prediction system of claim 1, wherein the environmental information includes indoor environmental information and weather environmental information, and the indoor environmental information is at least one of indoor humidity, fine dust, carbon monoxide, and carbon dioxide.

5. A single zone HVAC prediction method of an open plan large-scale building, comprising:

(a) collecting at least one of HVAC information, control information, facility-related information, and environmental information, respectively, through IoT terminals each installed inside and outside the building;

(b) collecting the HVAC information, the control information, the facility-related information, and the environmental information from the plurality of IoT terminals and then preprocessing the collected information to form a data set; and training the deep learning-based prediction model; and (c) applying the data set to a trained deep learning-based prediction model, and reflecting a correlation between the HVAC information and the control information and a daily pattern of the environmental information through time embedding to output an HVAC prediction value;

wherein in the training of the deep learning-based prediction model, a result of performing self-attention on the HVAC information and at least one of the control information and environmental information are additionally input to a first latent array to perform a first cross-attention, and the daily pattern of the environmental information through the time embedding is additionally input to a second latent array to perform a second cross-attention on a result of performing the first cross-attention, and then a latent expression is refined through a transformer and is trained to output an HVAC prediction value, wherein the HVAC prediction value is used to assist control of a single zone HVAC system.

* * * * *